US008547249B2

(12) United States Patent
David et al.

(10) Patent No.: US 8,547,249 B2
(45) Date of Patent: Oct. 1, 2013

(54) METHOD FOR AVOIDING COLLISION

(75) Inventors: Klaus David, Warburg (DE); Alexander Flach, Nentershausen (DE)

(73) Assignee: Universitaet Kassel, Kassel (DE)

( * ) Notice: Subject to any disclaimer, the term of this patent is extended or adjusted under 35 U.S.C. 154(b) by 181 days.

(21) Appl. No.: 13/076,897

(22) Filed: Mar. 31, 2011

(65) Prior Publication Data

US 2011/0210866 A1 Sep. 1, 2011

Related U.S. Application Data

(63) Continuation-in-part of application No. PCT/EP2009/062774, filed on Oct. 1, 2009.

(30) Foreign Application Priority Data

Oct. 1, 2008 (DE) ..... 10 2008 049 824

(51) Int. Cl.
*G08G 1/16* (2006.01)

(52) U.S. Cl.
USPC ..... 340/903; 340/901; 340/944; 340/435; 340/936; 340/933

(58) Field of Classification Search
USPC ..... 340/903, 901, 944, 435, 936, 933, 340/937; 701/301; 3/903, 901, 944, 435, 3/936, 933, 937
See application file for complete search history.

(56) References Cited

U.S. PATENT DOCUMENTS 5,635,922 A * 6/1997 Cho et al. ..... 340/903
6,429,790 B1 8/2002 Frese et al.
6,472,978 B1 * 10/2002 Takagi et al. ..... 340/435
6,861,959 B1 3/2005 Torres Sabate et al.

(Continued)

FOREIGN PATENT DOCUMENTS

DE 38 30 790 A1 3/1990
DE 197 05 647 A1 8/1998

(Continued)

OTHER PUBLICATIONS

International Preliminary Report on Patentability in co-pending related PCT Application No. PCT/EP2009/062774, mailed Oct. 1, 2009.

*Primary Examiner* — Hoi Lau
(74) *Attorney, Agent, or Firm* — Thomas | Horstemeyer, LLP

(57) ABSTRACT

The present invention relates to a method for avoiding a collision between a vehicle and another traffic participant. According to the inventive method, a cell phone carried by the traffic participant sends a signal including a position of the traffic participant. A processing unit processes the signal including the position of the traffic participant for a position or evaluation history. The processing unit determines an estimation of a future position of the traffic participant on the basis of the position or evaluation history. The processing unit evaluates a likelihood of a collision between the vehicle and the traffic participant on the basis of the estimated future position of the traffic participant and an estimation of a future position of the vehicle. An acceleration of the traffic participant is sensed by an acceleration sensor of the cell phone. This acceleration sensor is multifunctionally used by using the sensor also for a manipulation of the operating state of the cell phone by moving the cell phone. An action for avoiding a collision is automatically initiated in case that a distance of the future position of the traffic participant and the vehicle is smaller than a safety distance. According to the invention, the safety distance depends on the acceleration which is sensed by the acceleration sensor of the cell phone.

22 Claims, 5 Drawing Sheets

(56) References Cited

U.S. PATENT DOCUMENTS

| | | | | |
|---|---|---|---|---|
| 7,095,336 | B2 * | 8/2006 | Rodgers et al. | 340/903 |
| 7,181,343 | B2 | 2/2007 | Mukaiyama | |
| 7,457,705 | B2 * | 11/2008 | Takahashi et al. | 701/454 |
| 8,253,589 | B2 * | 8/2012 | Grimm et al. | 340/901 |
| 2002/0063637 | A1 * | 5/2002 | Eida et al. | 340/901 |
| 2003/0073406 | A1 * | 4/2003 | Benjamin et al. | 455/41 |
| 2005/0073438 | A1 * | 4/2005 | Rodgers et al. | 340/944 |
| 2006/0074549 | A1 * | 4/2006 | Takahashi et al. | 701/207 |
| 2006/0224300 | A1 | 10/2006 | Shioya et al. | |
| 2006/0250224 | A1 | 11/2006 | Steffel et al. | |
| 2006/0250244 | A1 | 11/2006 | Tsen et al. | |
| 2007/0018800 | A1 * | 1/2007 | Boss et al. | 340/435 |
| 2008/0114528 | A1 * | 5/2008 | Seacat et al. | 701/117 |
| 2011/0001635 | A1 * | 1/2011 | Akens et al. | 340/936 |

FOREIGN PATENT DOCUMENTS

| | | | |
|---|---|---|---|
| DE | 100 41 714 | A1 | 5/2002 |
| DE | 102 00 002 | A1 | 8/2002 |
| DE | 101 33 283 | A1 | 1/2003 |
| DE | 102 33 993 | A1 | 2/2004 |
| DE | 103 56 500 | A1 | 7/2004 |
| DE | 103 34 203 | A1 | 3/2005 |
| DE | 10 2004 050 597 | A1 | 4/2006 |
| DE | 10 2008 062 916 | A1 | 6/2010 |
| DE | 10 2009 035 072 | A1 | 2/2011 |
| EP | 0 433 351 | B1 | 2/1994 |
| JP | 2004-157847 | A | 6/2004 |
| WO | 99/063502 | B1 | 12/1999 |
| WO | 2004/068164 | A2 | 8/2004 |

* cited by examiner

METHOD FOR AVOIDING COLLISION

CROSS REFERENCE TO RELATED APPLICATIONS

This application is a continuation-in-part (CIP) of International Application PCT/EP2009/062774 with an International Filing Date of Oct. 1, 2009 and claiming priority to co-pending German Patent Application No. 10 2008 049 824.6 entitled "Verfahren zur Kollisionsvermeidung", filed on Oct. 1, 2008.

FIELD OF THE INVENTION

The present invention generally relates to a method for avoiding a collision between a vehicle and another traffic participant. The traffic participant might be a non-motorized traffic participant as a pedestrian or a cyclist.

BACKGROUND OF THE INVENTION

German Patent Application No. DE 101 33 283 A1 describes background art related with systems for avoiding a collision in road traffic basing upon measuring a distance between two vehicles by ultrasonic sound. Additionally, for moving vehicle these known systems process the actual driving velocity of the vehicle. In case of the measured distance going below a minimum safety distance a warning signal is given to the driver. It is also suggested to apply such systems for providing a parking assistance. Document DE 101 33 283 A1 bases on the finding that the aforementioned known systems are only directed to avoiding a collision between two vehicles, whereas these systems are not designated for increasing the safety of the group of non-motorized traffic participants. On the basis of this observation the patent application suggests equipping non-motorized traffic participants with a specific warning device. The warning device produces a warning signal in case that the non-motorized traffic participant moves with a distance to a vehicle causing the likelihood of a future collision. The warning signal might be an acoustic, optical or haptic warning signal or a spoken output, wherein the spoken output might also include additional information concerning the further circumstances of the critical situation. The warning device might also be a cell phone. For determining the likelihood of a future collision the warning device carried by the traffic participant receives signals sent by a so called inter-vehicle-communication-system. Usually these signals are only provided for exchanging information between vehicles. The signals might include information related with an identification of the vehicle, a position and a heading of the vehicle. The warning device processes and evaluates these signals for triggering a warning signal in cases where necessary. Additionally, the patent application suggests equipping the warning device with a transmitting unit for transmitting a warning signal also to the vehicle being involved in the critical collision situation. Furthermore, it is possible that the operating or driving state of the vehicle is automatically changed by a direct control, e.g. by an automatic decrease of the driving velocity. There might also be a number of different automatic actions caused for changing the operating state of the vehicle. The appropriate action might be automatically chosen in dependence on the determined likelihood of a collision.

German Patent Application No. DE 102 33 993 A1 relates to a method for avoiding a collision with an emergency or rescue vehicle. The disclosed method bases on determining a future route of the rescue vehicle to its destination by a navigation system of the rescue vehicle. The rescue vehicle itself or a server of a cell phone network transmits at least a part of the future route of the rescue vehicle to vehicles in the neighborhood of the rescue vehicle. In these vehicles a warning signal is produced indicating to the driver of the vehicle that a rescue vehicle is approaching. The disclosed method provides the option that the rescue vehicle is at least temporarily moved without an acoustic signal or a siren. On the other hand, a signal might be transmitted from the rescue vehicle to a traffic light for switching the traffic light with the aim of avoiding stops of the rescue vehicle.

International Patent Application No. WO 99/63502 (corresponding to patent family member U.S. Pat. No. 6,429,790 B1) criticizes that in the road traffic the moving vehicles do not give any information upon their actual operating conditions and their further route to other vehicles. The only exception are direction indicators and stoplights of the vehicle. The document suggests equipping the vehicles with transmitters having a small operating distance for transmitting data related with security and collision avoidance. The signals emitted by the transmitters are received by other traffic participants moving within the operating distance of the transmitters. The use of transmitters with a small operating distance only automatically makes the signals accessible only for vehicles in a close distance from the vehicle with the transmitter. Accordingly, the amount of data to be processed by the vehicles is limited. WO 99/63502 also mentions using a cell phone as a transmitter. For avoiding a collision, the document suggests an exchange of information between vehicles as information related with a change of the driving direction or a change of a lane. On the basis of this information exchange, it is possible that the vehicle receiving the information might consider the future change of the situation already before the change takes place. The document also suggests equipping a pedestrian with a transmitter. The information exchange between the traffic participants might also be a position of a vehicle, a velocity of a vehicle or an operating state of the vehicle on the basis of data available via the CAN. Furthermore, transmitted information might be based on manipulations of the driver as the activation of a direction indicator, an activation of a windshield wiper for indicating a wet road, the activation of a fog lamp and the like. Furthermore, information related with traffic signals or traffic signs or the state of a traffic light might be processed. The unit receiving any such information might be linked with a processing unit. The processing unit compares information included in the received data with operating data of the related vehicle. On the basis of the comparison, the processing unit decides if the data received is relevant for the vehicle. In case that the data is relevant for the vehicle, a warning signal is triggered. The document also suggests an automated control of the drive train of the vehicle, e.g. by causing an automatic application of the brakes. The system might also be used in combination with cyclists, wherein the cyclist transmits information regarding his position and heading as well as his velocity to the processing unit.

U.S. Pat. No. 6,861,959 B1 relates to a warning system of a traffic participant with respect to a fixed obstacle.

German Patent Application No. DE 102 00 002 A1 discloses a method for determining a position of a vehicle or a traffic participant on the basis of a cell phone. A determined position is transmitted via a telecommunication device to a computer. The computer creates a virtual traffic world including positions, velocities, headings, destinations, routes and distances with the aim to approximate the real traffic world. The virtual traffic world is determined in real time. On the basis of the virtual traffic world warnings and instructions for the traffic participants are generated and transmitted to the traffic participants. The system is designed for detecting upcoming risks basing on the movement of the traffic participants and for bringing these upcoming risks to the attention of the traffic participants. The document also suggests a system "Seat Belt Alcohol Controller over position change" (SBAC) for monitoring the use of a security belt. Furthermore, the system also provides the option of detecting drunken drivers.

US Patent Application No. US 2006/0224300 A1 discusses prior art as JP 2004-157847 A using a position and a velocity of a traffic participant having a cell phone for a traffic security system. In case that the traffic participant passes a crossroad or a pedestrian crossing, this information is transferred to a navigation system of a vehicle for causing a warning signal for the driver. Any such warning signal is only generated after the pedestrian has entered the road. The patent application relates to a prediction of a future possible collision situation. The disclosed system determines a traffic distribution with a velocity distribution of the traffic participants as well as a distribution of the headings of the traffic participants, wherein the determined information and data is filtered. On the basis of the filtered information, traffic jams are predicted. Furthermore, driving routes with a large number of pedestrians causing an increased likelihood of an accident might be detected. A generated image of the traffic distribution including the movement of pedestrians is suggested in particular for use when driving at night or in the fog. A velocity of a traffic participant is determined by the quotient of a distance of two positions of the traffic participant at two distinct points in time and the time intervals between these two points in time. Furthermore, for the traffic participant a maximal velocity is determined within a processing history from the determined positions. Also a moving direction of the traffic participant is determined. The movements of a plurality of traffic participants are systemized in a plurality of classes. It is assumed that a traffic participant "rests" in case that a determined velocity or a maximum of a plurality of determined velocities of the traffic participant is smaller than 20 m per minute. A traffic participant is systemized as a pedestrian in case of the maximal velocity being in the range of 20 to 200 m per minute. A traffic participant is systemized as a vehicle in case of the maximum of the velocity being larger than 200 m per minute. From the position information of a plurality of traffic participants a density of the traffic is calculated. In a navigation system of a vehicle the movements of pedestrians are indicated by velocity arrows. The driver of the vehicle has the option to select different modes of the navigation system for displaying only resting traffic participants, pedestrians and/or vehicles.

Also German Patent Application No. DE 103 34 203 A1 discloses a system for a prevention of traffic accidents. The system bases on a direct automatic communication between traffic participants without a central station used between the communicating traffic participants. Exchanged historical data related with the operation of the vehicle is used for determining a velocity, direction and a driving style of the traffic participant. Furthermore, the exchanged data is used for automatically determining so called "causal expectation data". An algorithm uses transmitted data and parameters for calculating an actual position, a time dependent change of the position, a future velocity vector, the attention of the driver, the driving style and the quality of the view of the driver. Considered parameters might include a longitudinal or transverse dynamic of the vehicle or critical driving states, an automatic activation of an electronic stability program or operating parameters of a program ANB. Parameters considered by these systems might be pedal positions, steering parameters, the slip of the wheels, the number of revolutions of the wheels, data from the tachometer, the engine speed, the used gear of the transmission, the input speed of the differential, the driving style, the age of the driver, the fitness to drive or the roadworthiness, the attention of the driver, the noise level in the vehicle, the view of the driver, e.g. monitored by video cameras and image processing, the use of a windscreen wiper, the use of the headlamps or fog lights, the use of a blinker, the use of hazard warning flashers, the use of a horn, distances and relative velocities of vehicles running ahead, distances and relative velocities to fixed obstacles, e.g. measured by radar sensors, infrared sensors, an image processing on the basis of camera systems, the use of information from the rearview mirror, information about traffic participants or obstacles laterally from or behind the vehicle, the type of road, the traffic flow, the density of flow in the different lanes, the traffic density, the state of traffic lights, traffic signs, construction sites, alternative routings, information from traffic guidance systems and the like. In case that the driver is inattentive, information is automatically triggered or an automatic intervention strategy for the vehicle is calculated. Also traffic participants as pedestrians, cyclists or motorcyclists are included into the system, e.g. by use of a cell phone carried by these traffic participants. When detecting a critical situation, the system might automatically intervene into the operation of the vehicle, e.g. by an emergency brake application also in case that the driver himself does not systemize the present situation as requiring an emergency brake actuation. Also the automatic control of a security system might be included into the system.

German Patent Application No. DE 100 41 714 A1 suggests equipping persons, vehicles or objects as a ball played by a child with specific transmitting and receiving units. By means of a transmission of a position signal the automatic determination of a position of an object in the traffic is provided. Furthermore, an identification signal with an object identification is transmitted. On the basis of the object identification with the determination of a position of an object it is also possible to determine the type of object. Accordingly, the proposed method is able to distinguish a pedestrian from a playing child, a slowly moving traffic participant as an agricultural vehicle, a wheelchair user, a cyclist, a resting vehicle or an object as a ball or an object protruding into the road as a scaffolding. The calculated reaction of the receiving object for avoiding an accident might depend on the type of received identification signal. For one embodiment, in an emergency situation it is avoided that the driver of the vehicle has to react on a ball rolling upon the road which might be followed by a child. Instead, in case of receiving both an identification signal of a ball as well as of a child located close to the ball, the upcoming emergency situation is anticipated for adapting the velocity of the vehicle right in time. The patent application also suggests transmitting position signals at a plurality of times for detecting the moving direction of the object. On the basis of the detected moving direction, a likelihood of a collision is analyzed right in time. Furthermore, on the basis of the detected moving direction a motorist driving against the traffic on motorways is detected. The reach of the identification signal might be limited or adjusted. It is possible to adjust the reach of the identification signal in dependence on the moving velocity or a frequency of a change of the moving direction. An adjusted reach of the identification signal correlates with the possible moving space of the object. On the other hand, by a limitation of the reach of the identification signal in high density traffic areas the number of transmitted and received signals is reduced to the required amount. A device for detecting a driving direction or a moving direction of an object is integrated into the system. The receipt of a signal and the transmission of a signal might be controlled in relation with the chosen route, the velocity or the moving direction. For one example, the device only transmits the signals in case of the velocity of the vehicle exceeding a limit velocity, wherein the signals might also be transmitted in relation with a chosen route. Furthermore, the device might detect the lane the vehicle is moving on. It is also possible that the device only considers objects for the monitoring process that are moving into the same moving direction. For another embodiment, the device monitors a larger neighborhood or angular region for a playing child than for a vehicle moving with a larger velocity. The reason is that the vehicle might change its position faster than a playing child, whereas the playing child might change its moving direction faster than the vehicle. A transmitting device might be affixed to the clothing of a traffic participant. The velocity of an object is calculated by the quotient of a change of a position signal and the time interval between the position signals. A change of the moving direction is determined by a change of a signal intensity.

U.S. Patent Application No. US 2005/0073438 A1 suggests transferring data between a vehicle device and a device carried by a pedestrian. The vehicle device triggers an activation signal received by the pedestrian device for transferring a position information from the pedestrian device to the vehicle device. The transferred position information bases on a GPS signal and builds the basis for a collision monitoring by the vehicle device. It is also possible to base the collision monitoring on a relative distance signal between the devices calculated from a transfer time of a signal between the devices. The collision monitoring bases on an estimate of future positions of the vehicle and the pedestrian on the basis of determined positions, velocities and the moving directions. The estimation of future positions is repeated with a frequency that might depend on a moving velocity. Personal information is transferred from the pedestrian device to the vehicle device indicating whether the pedestrian is an adult or a child. It is also suggested to determine a position of a traffic participant on the basis of an image processing in territories monitored by cameras. The devices might also be equipped with inertial sensors used for sensing an angular velocity, a linear velocity, an acceleration, a driving direction and the like.

Further prior art is known from documents DE 197 05 647 A1, DE 10 2004 050 597 A1, DE 103 56 500 A1 (corresponding to patent family member U.S. Pat. No. 7,181,343 B2) and DE 38 30 790 A1 (corresponding to patent family member EP 0 433 351 B1).

German Patent Application No. DE 10 2009 035 072 A1 filed after the priority date of the present patent application and not published before the application date of the present International Patent Application relates to a method for a prediction of a position of a traffic participant as a pedestrian for avoiding a collision. The document suggests that the pedestrian carries a specific movement sensor sensing data related with the movement as a velocity, an acceleration, a deceleration, a turning movement, a change of the orientation and the like. The movement sensor might sense a longitudinal, transverse or vertical acceleration of the pedestrian resulting in a two- or three-dimensional acceleration vector. It is also possible that a two- or three-dimensional gyration vector results from the sensor. The prediction uses a so called "object model" with a set of parameters describing physical or physiological characteristic features of the pedestrian, in particular the weight, size, maximal velocity, maximal acceleration, maximal gyration and/or a movement pattern of the pedestrian. Furthermore, the documents suggests that the movement sensor might be integrated as an additional component into a cell phone, wherein the keypad of the cell phone might be used for inputting the aforementioned parameters. In case of detecting an upcoming collision the driver receives an optical, acoustic or haptic warning. In case that the driver does not react on the warning an automatic brake action is performed. In case of an upcoming collision the engine hood is automatically lifted towards the colliding object prior to the collision. In case of airbags being integrated into the front part of the vehicle for protecting a pedestrian during a collision, these airbags might be blown up prior to the collision.

German Patent Application No. DE 10 2008 062 916 A1 filed after the priority date of the present patent application and not being published before the application date of the underlying International Patent Application discloses a method for determining the probability of a collision of a vehicle with a pedestrian by use of communication devices not specified in the patent application.

SUMMARY OF THE INVENTION

The present invention relates to a method for avoiding a collision between a vehicle and another traffic participant, e.g. between a vehicle and a non-motorized traffic participant as a pedestrian or a cyclist. In particular, the present invention relates to a simple method for collision avoidance with reduced needs for the equipment of the traffic participants.

Another object of the present invention is to provide a simple but effective collision avoidance basing on a cell phone carried by the other traffic participant.

The present invention uses a cell phone anyway carried by the traffic participant for a collision avoidance. It is possible that the cell phone (in some cases also without modifications of the cell phone itself) transmits a signal indicating a position of the traffic participant. The invention uses a processing unit processing an evaluation history or "position history" including at least two discrete position signals at two different points in time. The invention also covers processing a plurality of discrete position signals as well as a continuous position signal.

On the basis of the position history, the processing unit determines an estimate of a future position of the traffic participant. Whereas according to the above prior art WO 99/63502 a transmitter related with the pedestrian or the cyclist has to know both the position and the moving direction, according to the inventive method it is also possible that this information might be determined from the position history. In the simplest case, the inventive method calculates a velocity vector from two position vectors $y(t_1)$ and $y(t_2)$ at times $t_1$ and $t_2$ for the movement of the traffic participant. The calculated velocity vector (under the assumption of a smooth continuation of the movement of the traffic participant) is used for an extrapolation of a future position of the traffic participant. However, without additional constructive measures the estimate of a future position might also be based on additional information. To mention only one example, it is possible to determine a change of the moving direction and/or a change of the velocity from the position history and to consider this determined information for the estimate of a future position. Furthermore, in the estimate of a future position known fixed obstacles might be considered. Besides the estimate of the future position of the traffic participant, the processing unit also considers an estimate of a future position of the vehicle. On the basis of these estimates, the processing unit evaluates the likelihood of a future collision. In the simplest case, the processing unit decides that a likelihood of a future collision is given in case of the distance of the estimated future positions of the vehicle and the traffic participant getting smaller than a safety distance.

It is possible that the processing unit is integrated into the vehicle or into a cell phone of the traffic participant. The processing unit might also be located distant from the vehicle and the traffic participant. It is also possible that the processing unit is located in a central cell phone station both receiving a signal from the cell phone of the traffic participant and transmitting a calculated signal, e.g. including the result of a monitoring of the likelihood of a collision, to the vehicle. Whereas for the discussed prior art it is known to automatically trigger an action for avoiding a collision in case that the distance of the future positions of the vehicle and the traffic participant becomes smaller than a fixed safety distance, the present invention uses a variable safety distance:

The invention suggests to use a safety distance in dependence on an acceleration sensed by an acceleration sensor of the cell phone. Modern cell phones anyway comprise an acceleration sensor used for the operation of the cell phone by moving, in particular tilting or shaking, the cell phone. Accordingly, the acceleration sensor of the cell phone is used for at least two functions. The acceleration sensor in the sense of the present invention might also be based on a gyroscope.

For the processing of the acceleration signal of the acceleration sensor of the cell phone there are a lot of different options covered by the present invention. In the following only some of these options are explained:

a) In case that the acceleration sensor of the cell phone measures an acceleration indicating a change of the moving direction and/or moving velocity of the traffic participant, this change directly influences the likelihood of a future collision which according to the invention is considered by an adaptation of the safety distance used in the inventive method.

In case of the traffic participant accelerating his movement towards the driving route of the vehicle or in case of the traffic participant changing his moving direction versus the estimated route of the vehicle, the likelihood of a collision is increased which is considered in an inventive embodiment by increasing the safety distance.

On the other hand, the sensed acceleration might be used as an indicator for an agility of the traffic participant or the stress level of the traffic participant leading to the assumption that the traffic participant will not move steady or uniformly but will move with changing directions and accelerations with an increased potential of a collision. In this case, the safety distance is increased.

The use of the signal of the acceleration sensor of the cell phone leads to an increased precision of the acceleration signal when compared to an acceleration signal calculated from a position signal, e.g. on the basis of building the second derivative of the position signal with respect to time. A position calculated from a GPS signal comprises an error of up to 10 m so that also the acceleration signal calculated from this position might includes an error.

b) It is also possible to use different accelerations or acceleration components of an acceleration sensor of the cell phone. To name only one example, the invention might consider a vertical component of the acceleration signal for detecting that the traffic participant is sitting down or standing, moving upstairs or downstairs. Also this information might be considered when choosing an appropriate safety distance.

Furthermore, a vertical component of the acceleration might be used for counting the steps of the traffic participant or a frequency of his pace. In case of an increased frequency of the pace, there is a larger likelihood that the traffic participant is stressed or in a hurry. This might be considered by the invention by an increased safety distance.

It is also possible to detect a smooth movement of the traffic participant on the basis of the acceleration sensor.

By an analysis of a vertical acceleration, it is also possible to detect a limping traffic participant being considered as a traffic participant with a reduced agility.

The present invention also covers considering different types or components of the acceleration signal, also together with other parameters for determining the safety distance.

For another embodiment of the invention, the cell phone contains so called "context information" or "background information" (in the following "context information"). A context information includes any information that does not base on the recent position or evaluation history derived from the signal of the cell phone e.g. for the last 10, 20 or 30 seconds. Furthermore, the context information might include any information related with the further background of the traffic participant (or the owner of the cell phone), e. g. the further living conditions, the capability of moving and the potential of creating the risk of an accident for the traffic participant. In the following some examples are mentioned for context information that do not (solely) base on information concerning the actual traffic situation but base on a-priori information not related with the actual traffic situation.

a) It is possible that the contact information is information that has been input by the traffic participant or a third party and relates to the traffic participant. Such data might be input into the cell phone some time ago or at the initial operation of the cell phone. One example for such context information is the age of the owner of the cell phone.

In case of an age being input indicating that the traffic participant is a child, this input indicates an increased potential of causing an accident which is due to the fact that a child might perform irrational movements in the traffic or might suddenly change the direction of movement, might jump on the road or might suddenly speed up the movement.

An input middle age indicates a more rational movement in the traffic with a decreased potential of an accident.

Traffic participants with a larger age might have a reduced reaction capability or reduced acoustic or optical capabilities leading to an increased likelihood of an accident. According to the context information related with the age, the safety distance might be decreased or increased, wherein an increased potential for an accident should be considered in an increase of the safety distance. It is also possible that the traffic participant inputs the result of his own analysis about his reaction capability, his accelerating behavior and/or the rationality of his movements in the traffic into his cell phone.

Furthermore it is possible that the context information includes the weight of the traffic participant that is considered for the safety distance, wherein an increased weight might results in a decreased safety distance due to a reduced acceleration capability.

b) Furthermore, it is possible that the context information is automatically "learnt" throughout the use of the cell phone.

It is possible that the context information determines the maximum of the velocity of the traffic participant with which the traffic participant (and the cell phone) has moved during a given time period, e.g. the last 30 days. In case that the maximum of the velocity is 24 km/h, it is assumed that the traffic participant is a sportive person able to perform fast movements and changes of the moving directions and quick accelerations. This might results in a safety distance which is larger than for other traffic participants having a smaller maximum of the velocity within the given time period.

Accordingly, also the health condition of the traffic participant (healthy, invalid, disabled, limping and the like) might be input into the cell phone as a context information or might be "learnt" automatically by the cell phone.

c) Furthermore, it is possible that in the cell phone an agenda with meetings, dates and due terms of the traffic participant is stored. From the agenda, here the number of dates or the remaining time to a date, it is automatically analyzed whether the traffic participant is stressed or relaxed. In case of the agenda indicating that the traffic participant is stressed to a larger extent, e.g. due to a large density of dates in the agenda or short remaining time to a date, the safety distance is increased. For another embodiment, the actual time is compared with the starting time of the next upcoming date in the agenda. Additionally or alternatively, it is also possible to consider the actual position of the traffic participant and the location of the next date. In case that the remaining time between the actual time and the time of the next date is short and/or not sufficient for reaching the location of the next date which is also stored in the cell phone, this analysis is taken as an indicator that the traffic participant is in a hurry for attending the date. This result is considered by an increased safety distance.

For another embodiment of the invention, the processing unit also considers a reaction ability of the traffic participant on the basis of the position history or evaluation history. In the simplest case, the reaction capability describes an agility or reaction velocity of the traffic participant. Accordingly, the reaction capability of an older traffic participant might be smaller than the reaction ability of a younger traffic participant. To name only one example, an older traffic participant moves slower than a younger traffic participant. It is also possible that the older traffic participant stops several times over his route for taking a rest. It is also possible that an older participant changes his moving direction slower or accelerates or decelerates his movement slower than a younger traffic participant.

According to another embodiment of the invention, the processing unit determines the reaction capability of the driver of the vehicle. The determined reaction capability might be the overall reaction capability of the driver, e.g. correlating with the age of the driver. Furthermore, the reaction capability might also cover a temporary reaction capability of the driver. To mention only some examples, the temporary reaction capability might be derived from a device for detecting the microsleep of the driver on the basis of movements of the eyelid or the size of the pupils or from the duration of the driving activity of the driver and the like.

The invention also suggests analyzing estimated future trajectories of the traffic participant and the vehicle by determining the distance of the future trajectories at a given point in future time. According to this embodiment, the future behavior and movement of the traffic participant and the vehicle are simulated. The simulated distance might be seen as a good estimation building the basis for an analysis of the likelihood of a collision. The method compares the distance of the trajectories or the future positions of the traffic participant and the vehicle with a safety distance indicating a possible future collision in case of the distance becoming smaller than the safety distance. The safety distance is dependent on the acceleration sensed by the acceleration sensor of the cell phone.

Additionally, the safety distance might depend on any operating or surrounding parameter of the traffic participant and/or the vehicle. To mention only some examples, the safety distance might be chosen larger for larger velocities of the vehicle and/or the traffic participant than for smaller velocities. Furthermore, the safety distance might depend on the condition of the road. E.g. for a wet road in rainy days or for the indication of wheel slip in particular sensed by an ABS system the safety distance might be increased.

It is possible that in the inventive method the processing unit analyses the signal transmitted from the cell phone for at least two positions at two distinct times. In case that the processing unit receives a plurality of signals from a plurality of cell phones, in the processing unit also an identification code of a cell phone might be considered so that transferred position signals can be related to one and the same cell phone.

For another embodiment of the inventive method, the processing unit determines a moving state of the traffic participant under consideration of the positions. The moving state might in particular be a moving direction, a velocity and/or an acceleration calculated from a change of the position with time.

Another embodiment of the invention considers also data or information related with the neighborhood of the driver and/or the traffic participant. In case that the vehicle moves close to traffic lights or to an obstacle related data might indicate whether the vehicle will accelerate or decelerate which is considered for determining the future trajectory or future position. It is also possible to use information related with the route (e.g. information from the navigation system for anticipating that the vehicle drives along a curve, turns to the right at a crossroad with an anticipated deceleration or drives along a straight route without a change of the velocity or with an expected acceleration).

Furthermore, it is possible that the processing unit considers operating dates of the vehicle for an estimate of a future position of the vehicle. To name only some examples, the processing unit might consider the position of a pedal of the vehicle, e.g. a brake pedal, a clutch pedal or a gas pedal, the activation of a blinker for a prediction of a change of the moving direction and the like.

Another aspect of the invention cares for the number of signals to be processed by the processing unit. In case that the processing unit receives signals from a plurality of cell phones of a plurality of traffic participants, it is possible that the processing unit elects only the relevant signals so that only a subgroup of the received signals is completely processed. There are a lot of different criteria for electing the relevant signals.

According to one embodiment, only signals from cell phones moving with at least a limit velocity are considered. It is also possible that in a preceding processing step the processing unit has already performed an analysis of the signal of a cell phone and has for specific cell phones and related traffic participants decided that there is no likelihood of a future collision. In case of allocating identification codes to these specific cell phones for future processing steps, signal from these specific cell phones are no longer processed for a given or adjustable time.

The selection of only a subgroup of received signals for further processing reduces the amount of data to be processed and to be analyzed.

In case of detecting that the future positions have a distance smaller than the safety distance, an action designated for avoiding a possible future collision is automatically triggered. To name only some examples, such action might be a warning signal given to the driver, in particular an acoustic warning signal, an optical warning signal, e.g. in the console or display for the driver, or a haptic warning signal, e.g. a vibration of the driver seat, the steering wheel and the like. It is also possible that the action for avoiding a future possible collision might be an automatic change of the operating state of the vehicle, in particular of the powertrain of the vehicle. To name only some examples, the change might include moving the brake pads close to a brake disc so that for a subsequent brake actuation by the driver the reaction time of the brake is reduced. It is also possible that the action includes preparing the opening or opening a clutch in the powertrain. Another option for a suitable action might be a reduction of the angle of the throttle valve for reducing the velocity of the vehicle. It is also possible that the action is an automatic brake application or the actuation of a brake assisting system. In case of a plurality of different actions being provided, these actions might also be priorized. For one embodiment for the distance of the trajectories being below a first minimum safety distance the action is the provision of a warning signal for the driver, whereas for the distance of the future positions being below a second minimum safety distance smaller than the first minimum safety distance the automatic interaction with the operating state of the vehicle is triggered or controlled.

It is possible that the processing unit also interacts with other vehicles. It is possible that the action for avoiding a collision includes or coincides with sending a warning signal to at least one neighboring vehicle or traffic participant.

It is also possible that the action for avoiding a collision also includes transmitting a warning signal to the cell phone of the traffic participant, in particular to a pedestrian. For this embodiment, not only the vehicle and the driver of the vehicle are prepared for avoiding the collision but also the traffic participant gets a warning so that the traffic participant might initiate a change of his movement.

For another embodiment of the inventive method, the processing unit might analyze the signal of the cell phone with different frequencies or intensities in dependence on the position of the vehicle or the distance of the vehicle from the traffic participant. To mention one example for this embodiment, it is possible that the processing unit is not prepared for receiving a signal from a cell phone of a traffic participant in parts of the route as roads passing a desert or agricultural regions where the likelihood of a collision with a traffic participant or a pedestrian is very low. In these regions processing power is saved. Instead, increased processing power is provided when moving in parts of the route as urban areas, where the likelihood of a collision is large. Here, the processing unit is ready for receiving also a large number of signals from cell phones in the neighborhood. Further differentiations of the frequency or intensity of the receipt or processing of received signals might be done in the areas of larger likelihoods of a collision, e.g. crossroads with a large number of accidents, areas of schools or kindergartens and the like.

It is possible that the invention bases on a signal that is anyway sent (always or with a given frequency) by the cell phone. According to another embodiment of the invention, the signal of the cell phone is only sent in reaction on an activation signal of a vehicle close to the traffic participant. This measure reduces the required power for the transmitting activity of the cell phone.

In order to reduce the number of transmitted and received signals, it is also possible that signals from the cell phone are only transmitted in case that the traffic participant moves with the cell phone. Accordingly, a cell phone at rest (that might also be located distant from its owner or might be left in a parking vehicle) does not transmit additional signals that have to be processed by the processing unit or might be misinterpreted as a traffic participant.

It is also possible that a signal of another cell phone located in a resting vehicle is processed by the processing unit. In case of detecting that this cell phone and vehicle is at rest or parked and in case that another traffic participant, here a pedestrian, moves close to the resting vehicle, there is a large likelihood that the pedestrian might be covered by the resting vehicle indicating a situation, where the driver of another vehicle is not able to detect the pedestrian right in time. This is in particular the case when the pedestrian crosses a road between two parked vehicles.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

The present invention is in particular used for avoiding a collision between a vehicle 1, in particular a motor vehicle, and another traffic participant 2, which is in particular a non-motorized participant. For a simplification of the following description, it is supposed that the traffic participant 2 is a pedestrian. However, it is also possible that the other traffic participant 2 is a cyclist or another vehicle. The pedestrian 3 carries a cell phone 4.

Figure 1:
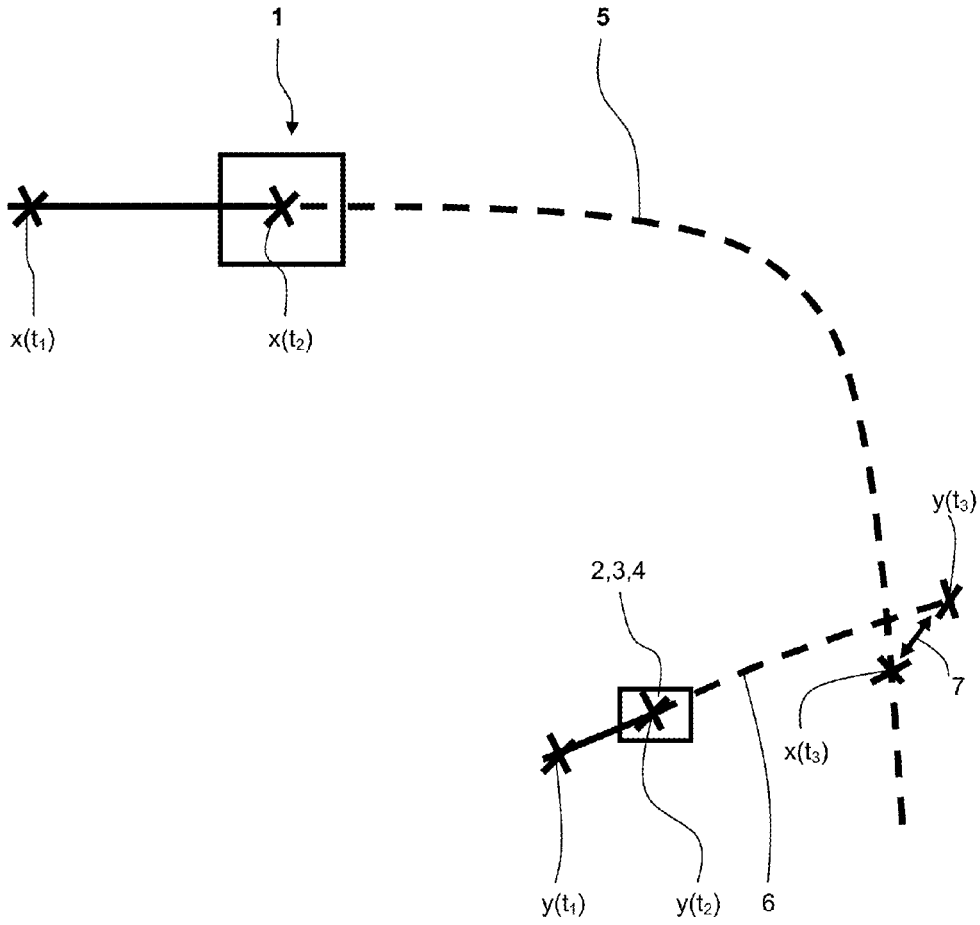
FIG. 1 is a schematic view with the trajectories of a vehicle and a traffic participant with the position or evaluation history and future trajectories.

FIG. 1 shows a vehicle 1 and a pedestrian 3 with a cell phone 4 at an actual time $t_2$ in a traffic situation. At the time $t_2$ the position of the vehicle 1 is described with the position vector $x(t_2)$, whereas the position of the pedestrian 3 with the cell phone 4 is described with the position vector $y(t_2)$. At a preceding time $t_1$ the vehicle has been located at the position $x(t_1)$, whereas at this preceding time $t_1$ the pedestrian 3 and the cell phone 4 have been located at the position $y(t_1)$. After the time $t_2$ the vehicle 1 is supposed to move along an estimated trajectory 5, whereas the pedestrian 3 and the cell phone 4 move along an estimated trajectory 6. At a future point in time $t_3$ with a possible collision these trajectories 5, 6 have a minimal distance 7 corresponding to the absolute value of the difference of the position vectors $y(t_3)-x(t_3)$. Under the assumption that the estimated trajectories 5, 6 at least approximate the real trajectories, a distance 7 of zero (or smaller than the dimensions of the vehicle 1 and the pedestrian 3) represents a collision between the vehicle 1 and the pedestrian 3.

Figure 2:
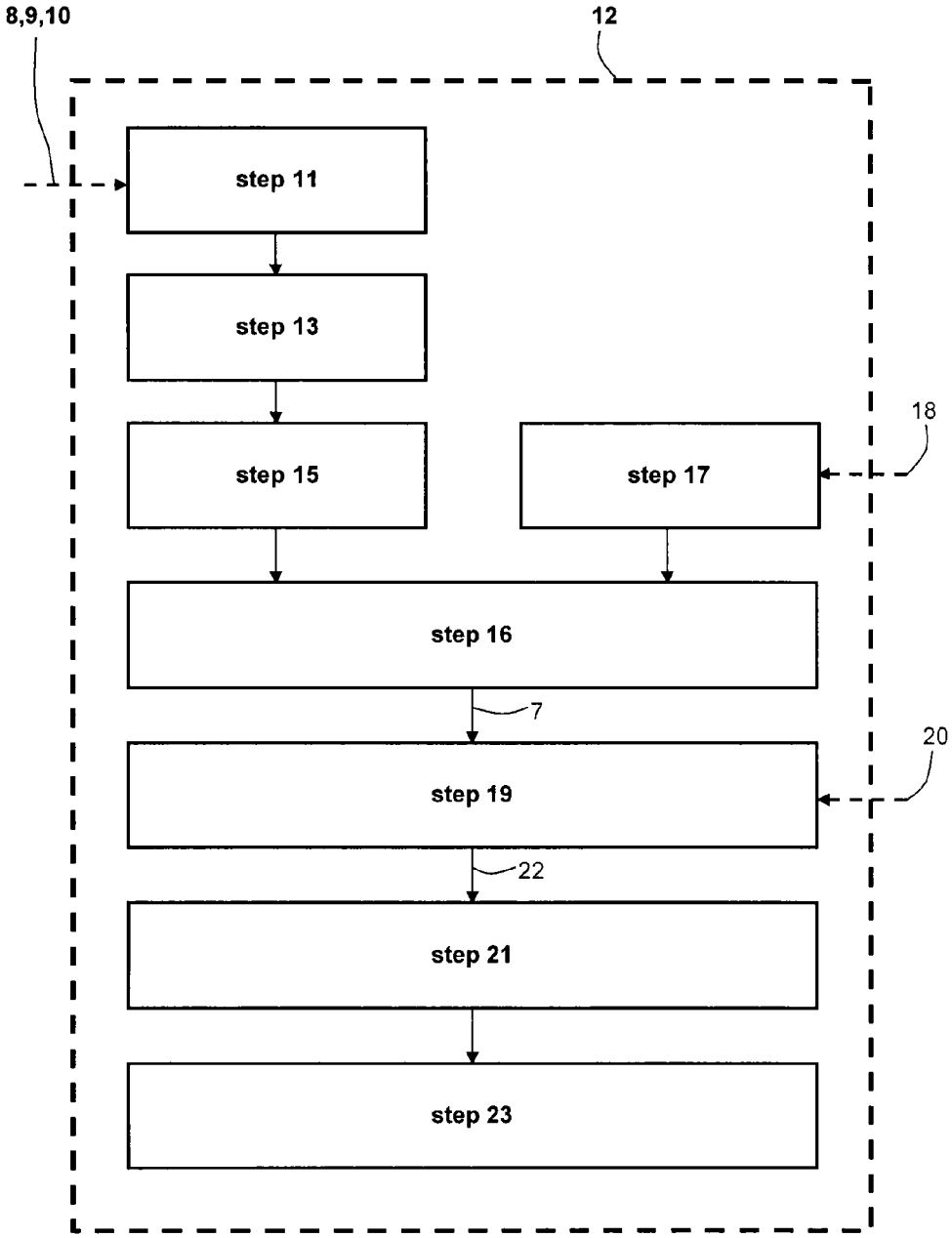
FIG. 2 is a schematic block diagram of a method according to the invention.

FIG. 2 shows a simplified block diagram for a method according to the invention. In this method the cell phone 4 of the pedestrian 3 sends a signal 8 comprising single positions 9, 10, i.e. position vectors $y(t_1)$ and $y(t_2)$. In a step 11 the signal 8 is received by a processing unit 12, so that also the positions 9, 10 are received and stored. On the basis of the positions 9, 10 in step 13 characteristic moving data is determined by the processing unit 12. In the simplest case, a velocity y results from $$y = \frac{(y(t_2) - y(t_1))}{t_2 - t_1}.$$

For a variant more than two positions might be used for a better estimation of the characteristic movement data or the calculated velocity. For one example, also an acceleration or a deceleration of the pedestrian 3 and/or of the vehicle 2 might be calculated. The characteristic measure of the movement 14 might be a kind of vector, whereas it is also possible that the characteristic measure of the movement 14 both includes the absolute value of a velocity of the pedestrian 3 as well as a direction of the movement of the pedestrian 3, in particular with an additional characteristic measure describing a future change of the velocity and/or the direction.

In a subsequent step 15 from the characteristic measure of the movement 14 an estimated trajectory 6 is determined by extrapolation of the position $y(t_2)$ to a future position. For the future movement, the characteristic measure of the movement 14 is extrapolated, which might also be done under consideration of a deceleration or acceleration or a change of the direction. The estimated trajectory 6 builds an input for step 16 performed in the processing unit 12. Parallel in step 17 the processing unit 12 determines an estimated trajectory 5 of the vehicle 1. For a determination of the estimated trajectory 5 of the vehicle 1, there are a lot of different options: it is possible that also for the estimated trajectory 5 a past position vector $x(t_1)$ is considered for calculating a velocity and/or a direction of the movement of the vehicle 1. However, also information available in the vehicle, e.g. information available over the CAN bus system, can be considered. It is also possible that in step 17 further information 18 is considered for an estimation of the trajectory 5. The information 18 might include information related with the operating state of the vehicle, in particular the actuation of a blinker indicating a future curvature of the trajectory 5, information of a map system indicating a future curve drive, information from the route planning of a navigation system, e.g. indicating the further route at a crossroad. In step 16 it is possible to determine for any future point in time $t>t_2$ the distance of the position vectors x(t), y(t) in dependence on the time t, wherein the distance 7 results from the absolute value of the difference of the position vectors x(t)−y(t). The minimum of a number of determined distances 7 for a plurality of future points in time $t>t_2$ is taken as an indicator for an estimated minimal distance 7 between the vehicle 1 and the pedestrian 3. The minimal distance 7 is then transferred to step 19. In step 19 it is analyzed if the minimal distance 7 is smaller than a predetermined safety distance. Here, the safety distance might be dependent on information 20 transferred to the processing unit 12. To mention only some examples, a larger safety distance might be considered in case that the information 20 indicates that the road is wet. Such an information might be derived from the actuation of a windshield wiper or an ABS control system or an antiskid control system. It is also possible that the information 20 indicates that the pedestrian 3 has a reduced reaction capability or the driver of vehicle 1 is tired. In these cases, an increased safety distance is used.

According to a comparison of the minimum distance 7, a collision indicator 22 is transferred to step 21. In the simplest case, the collision indicator 22 is a binary signal "collision possible" or "collision not possible". However, it is also possible that the collision indicator 22 includes the probability or the estimate of the likelihood of a collision, e.g. on a scale from 1 to 10. In step 21 an action for avoiding a collision is triggered, wherein the action might be an optical warning, an acoustic warning or a haptic warning as a vibration. It is also possible that the action triggered in step 21 is an interaction with the powertrain.

In an optional additional step 23, the processing unit 12 might send a signal to the pedestrian 3 via the cell phone 4 and/or to at vehicles in the neighborhood, which is done in order to give a warning to the pedestrian and/or the other vehicles.

Figure 3:
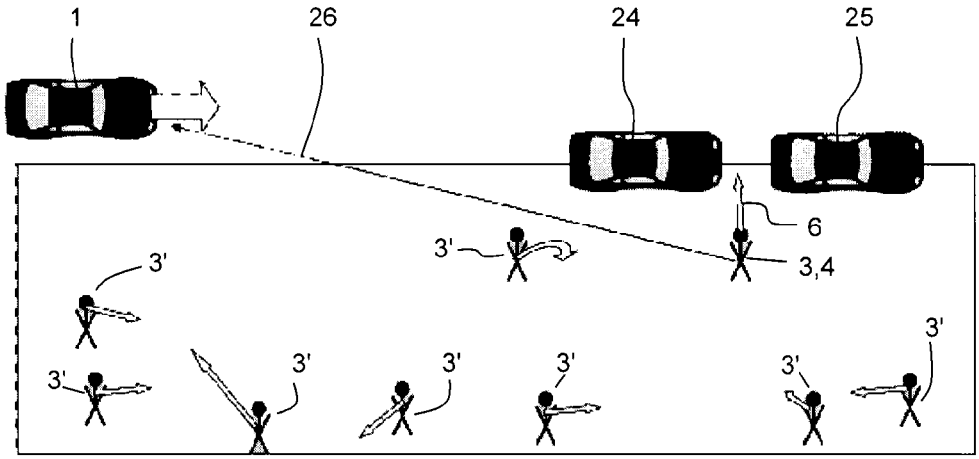
FIG. 3 is a traffic situation in an ad-hoc-network for performing a method according to the invention.

FIG. 3 shows a possible traffic situation, wherein a vehicle moves along a road with parked vehicles 24, 25 at the road. There is a plurality of pedestrians moving along the roads in different directions with different velocities. In FIG. 3 the velocities are indicated by the length of the shown vectors, whereas the direction of the movement of the pedestrians correlates with the orientation of the vectors. In FIG. 3 only one relevant pedestrian 3 with the related future trajectory 6 is shown. There is a large probability that the trajectory 6 will intersect with trajectory 5 of vehicle 1. Pedestrians systemized as not being of further relevance are denoted with the reference numeral 3'.

The pedestrian 3 intends to cross the road between the two parked vehicles 24, 25 so that the pedestrian 3 is covered by vehicle 24 for the driver of vehicle 1 approaching vehicles 24, 25.

Figure 4:
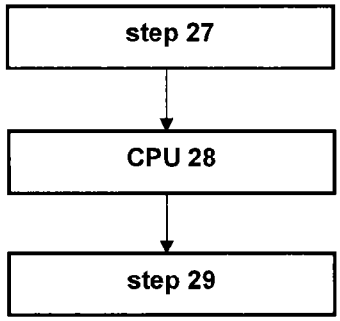
FIG. 4 is a schematic block diagram for the method used in the ad-hoc-network according to FIG. 3.

FIG. 4 schematically shows another method according to the invention. An ad-hoc-connection 26 is established between the vehicle 1 and the pedestrian 3 or his cell phone 4. In step 27 a data transfer is initiated between the cell phone 4 of pedestrian 3 and the vehicle. In this case the processing unit 12 is located in the vehicle 1. Besides the pedestrian 3 shown in FIG. 3 data is also transferred from other pedestrians 3' denoted in FIG. 2. In the subsequent step 28, the processing unit 12 eliminates signals from pedestrians 3' for which the likelihood of a collision with the vehicle 1 is not given or may be neglected. This type of elimination or filtering bases on data transferred from the pedestrians 3', in particular the distance to the road or the vehicle 1, the velocity and/or the moving direction of the pedestrian 3'. It is also possible that a reaction capability of the pedestrian 3' is considered for this elimination process. The processing unit 12 identifies at least one pedestrian 3 with a relevant likelihood of a collision with the vehicle 1. For this at least one pedestrian 3 an action for avoiding a collision is triggered in step 29.

Figure 5:
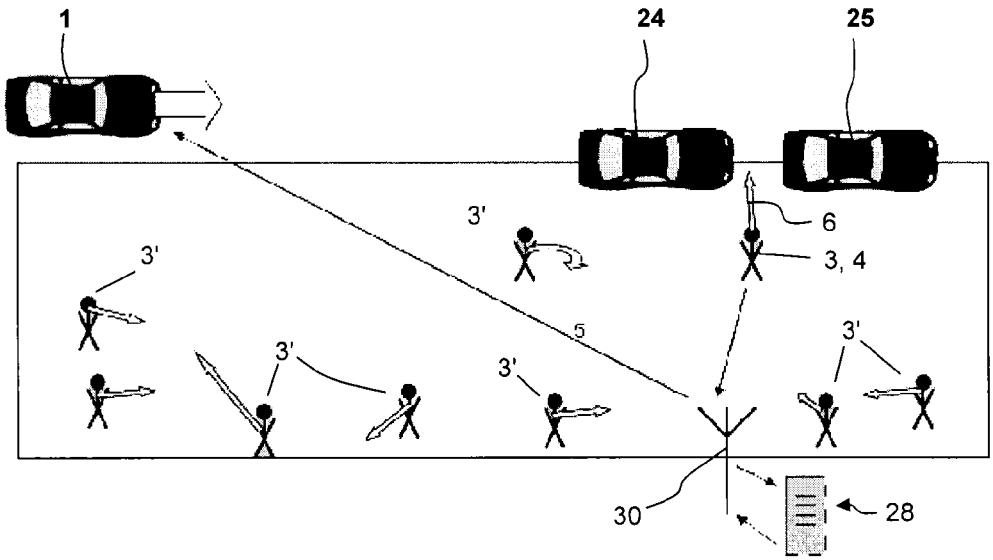
FIG. 5 shows a traffic situation in a cellular network for a central evaluation of a possible collision in a central processing unit with fixed location.
Figure 6:
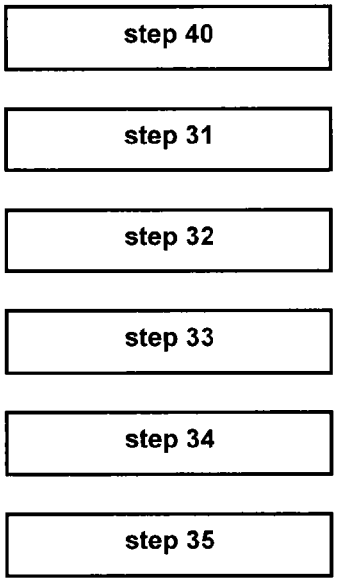
FIG. 6 shows a schematic block diagram for a method for the cellular network with the central processing unit according to FIG. 5.

FIG. 5 shows another construction, wherein the processing and evaluation is performed in a central processing unit 28 that might be a central unit of the cell phone system. Here, in step 40 data from a pedestrian 3 (and from other pedestrians 3') is transferred to a basic station 30. In step 31 received information is transferred from the basic station 30 to the central processing unit 28. In step 32 the central processing unit filters or eliminates a part of the information and data as described above so that pedestrians 3 are identified and selected having a relevant likelihood of a collision, whereas pedestrians 3' without the likelihood of a collision are sorted out. In step 33 the result of the former steps (in particular an identification of a position, where the trajectories of the pedestrian 3 and the vehicle 1 intersect or have a small distance from each other, or a collision indicator 28) are transferred to the basic station 30. In step 34 this information is transferred from the basic station 30 to the vehicle 1. Finally, in step 35 the action for avoiding a collision in automatically triggered.

Figure 7:
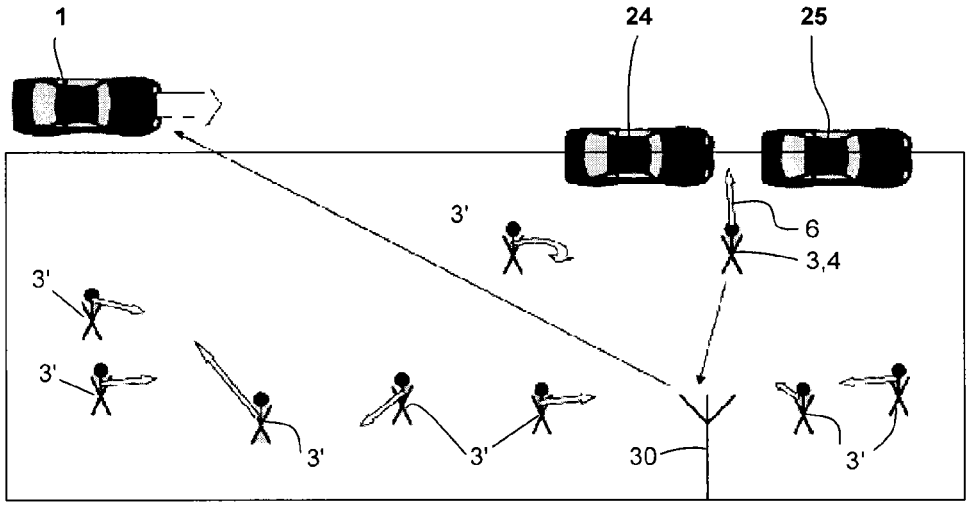
FIG. 7 shows a traffic situation in a cellular network with an evaluation performed in a processing unit located in a vehicle.
Figure 8:
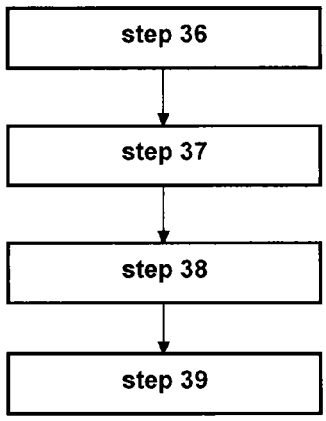
FIG. 8 shows a schematic block diagram for a method for an evaluation in the processing unit located in a vehicle according to FIG. 7.

For the method shown in FIGS. 7 and 8, in step 36 data is transferred from the cell phone 4 of the pedestrian 3 to the basic station 30. In the subsequent step 37 information is transferred from the basic station 30 to the cell phone of the vehicle 1. In step 38 the processing and evaluation is performed in the processing unit 12 which is in this case located in the vehicle. The analysis comprises determining which persons 3, 3' are located close to the vehicle 1 and for which persons 3 there is a sufficient relevant likelihood of a collision. In step 39 the processing unit 12 of vehicle 1 triggers an action for avoiding a collision.

Parameters describing the reaction capability of pedestrian 3 and/or the driver of vehicle 1 might be manually input into the cell phone 4 of the pedestrian 3 or in the processing unit 12, 28. The reaction capability might correlate with the age of the person. It is possible that the age is manually input into the cell phone 4 or the processing unit 12, 28. It is also possible that the reaction capability is automatically determined, e.g. by means of analyzing the grade of the driver of the vehicle 1 being awake, by analyzing the duration the driver is driving his car without any break and/or by observing the movements of the vehicle 1 or of the pedestrian 3. The estimated reaction capability might be considered for choosing an appropriate safety distance in step 19.

For a communication between the vehicle 1 and the cell phone 4 cellular technologies as GSM, GPRS, EDGE, UMTS and HSDPA might be used. Furthermore, future new products as LTE and NGMN might also be used. Another option used for the communication are ad-hoc-networks as e.g. WLAN, Blue Tooth, WiMax. A determination of a position via GPS, which might later be replaced by Galileo, might rely on different running times of the signals. Also combinations of the aforementioned techniques are possible, in particular for increasing the precision or for crosschecking the calculated data.

The data is transferred in IP packages or other suitable data packages to the processing unit 12, 28. These packages might include the position, velocities, accelerations, directions of movements and changes of the aforementioned signals as well as data related with the reaction capability.

The reaction capability or reaction dynamic of a driver of vehicle 1 or the pedestrian 3 might be determined by the user or a third person or might be determined automatically. This reaction capability might be determined on the basis of physiological information or medical information that might be manually input into a component of the system. For an automatic determination of the reaction capability, it is possible that the system monitors the driver or the pedestrian and correlates the determined reaction capability with the maximum of the monitored velocity of the movement or the maximum of the monitored acceleration. The user or owner of the cell phone might manually input data related with the weight of the user, the age, the own estimate of the reaction dynamic, information related with a limping movement and others. For an automatic evaluation of the reaction capability of the pedestrian, a maximum velocity within the chosen position history or evaluation history might be used. The velocity of a pedestrian is assumed to be in the range of 0.625 m/s to 12.5 m/s. This range might be divided into ten subunits for a systemization, wherein any velocity in this range is systemized in the ten categories from 1 to 10. Here, the number 1 corresponds to the lowest velocity subrange, whereas the number 10 corresponds to the highest velocity subrange. The steps between the categories 1 and 10 might be linear or non-linear. The probability of a change of the moving direction of the pedestrian might be correlated with the relevant subrange of the movement of the pedestrians. The slower the pedestrian moves, the more the pedestrian is able to change his direction. The method might consider changes of the moving direction up to 180° in case that the pedestrian moves slowly enough. Similar to the option of determining the likelihood of a change of the moving direction on the basis of the above subranges, the likelihood of a deceleration might also be estimated. Also here, the actual velocity of movement might be systemized in subcategories from 1 to 10. The faster the pedestrian moves, the longer it takes to decelerate on 0 m/s velocity. All the information is transferred solely to the processing unit 12, 28, wherein any use of the information different from the above described steps is not possible. Accordingly it is avoided that any user of the system gets knowledge e.g. about the medical condition of another user. The evaluation history or position history in particular only relates to a short time interval before the actual point in time. The data is stored in a row or array of position data. It is also possible to store a measure correlating with the frequency or spontaneity of the pedestrian of suddenly changing the moving direction.

It is possible that a change of the velocity of a vehicle 1 requires a new selection or filtering process and requires a new estimate of the trajectory 5 of the vehicle 1 which might under some circumstances lead to different pedestrians 3 having a large likelihood of a collision.

It is also possible to use the inventive method for avoiding suicides at railway lines. In this case the train builds the vehicle 1, whereas the person intending to commit suicide with its cell phone is the other traffic participant which moves close to the railway line, e.g. in the region of a bridge. It is possible that different regions of the railway line are categorized with respect to their potential of a person committing suicide in this region. In case that the evaluation history or position history for the person leads to the result that the person for a longer time moves or rests within the preselected region, this might be seen as an indicator for a large likelihood of a future collision.

For an alternative embodiment, the vehicle might be the train, whereas the other traffic participant might be a motor vehicle with a cell phone integrated into the vehicle itself or carried by the driver of the vehicle. Here, the inventive method might be used for detecting a possible collision in case of the vehicle moving towards an unguarded railway crossing.

In case of the vehicle being a train, the estimate of the future trajectory is very simple due to the fact that the trajectory is predetermined by the railway. In this case, it might be sufficient only to process data related with the position, velocity and/or acceleration of the train for estimating a future position.

Many variations and modifications may be made to the preferred embodiments of the invention without departing substantially from the spirit and principles of the invention. All such modifications and variations are intended to be included herein within the scope of the present invention, as defined by the following claims.

We claim:

1. A method for avoiding a collision between a vehicle and a non-motorized traffic participant comprising the following steps:

a) a cell phone carried by the traffic participant sends a signal including positions of the traffic participant, b) a processing unit processes the signal including the positions of the traffic participant for a position history or evaluation history, c) the processing unit determines an estimation of a future position of the traffic participant on the basis of the position history or evaluation history, d) an acceleration of the traffic participant is sensed by an acceleration sensor of a cell phone carried by the traffic participant, wherein said acceleration sensor is also used for a manipulation of the operating state of said cell phone by moving said cell phone e) an action for avoiding a collision is automatically initiated in case that a distance of the future position of the traffic participant and said vehicle is smaller than a safety distance, wherein the safety distance depends on ea) the acceleration sensed by the acceleration sensor of the cell phone and eb) background information or context information related with the traffic participant, said background information or context information being selected from the group consisting of:

background information including the weight of the traffic participant which has been stored in the cell phone and which is replaced, background information being learned throughout the use of the cell phone wherein the learned background information or context information does not base on an evaluation history of the last 10 seconds, and background information including an agenda of said traffic participant which is stored in the cell phone, wherein the safety distance is increased if the actual time is so close to a meeting time stored in said agenda that the remaining time is too short for reaching the location of the next date stored in the agenda of the cell phone.

2. The method of claim 1, wherein said processing unit determines a reaction capability of the traffic participant on the basis of the evaluation history, wherein the safety distance depends on the determined reaction capability of said traffic participant.

3. The method of claim 1, wherein the processing unit processes said signal of the cell phone for positions at least two points in time.

4. The method of claim 1, wherein said processing unit determines a moving state of said traffic participant under consideration of said evaluation history.

5. The method of claim 4, wherein said processing unit determines a moving state of said traffic participant under consideration of said positions at least two different points in time.

6. The method of claim 1, wherein said processing unit considers or determines a moving state of said vehicle.

7. The method of claim 1, wherein said processing unit considers data related with the surrounding area of the vehicle or the traffic participant for determining a future position of said traffic participant.

8. The method of claim 1, wherein said processing unit determines a future position of said vehicle under consideration of operating data of said vehicle.

9. The method of claim 1, wherein said processing unit determines a future position of said vehicle under consideration of a navigation system.

10. The method of claim 1, wherein the safety distance depends on a condition of a road at said vehicle or said traffic participant.

11. The method of claim 1, wherein said processing unit selects relevant signals when receiving signals from a plurality of cell phones of a plurality of traffic participants.

12. The method of claim 11, wherein said relevant signals are chosen under consideration of background information or context information related with a traffic participant.

13. The method of claim 11, wherein said relevant signals are chosen under consideration of an acceleration sensed by said acceleration sensor of said cell phone of said traffic participant.

14. The method of claim 11, wherein said relevant signals are chosen under consideration of a determined reaction capability of a traffic participant related with a cell phone.

15. The method of claim 1, wherein said automatic action for avoiding a collision comprises giving a warning signal to the driver of said vehicle.

16. The method of claim 1, wherein said automatic action for avoiding a collision comprises changing an operating state of said vehicle.

17. The method of claim 1, wherein said automatic action for avoiding a collision comprises sending a warning signal to at least one vehicle in the neighborhood of said vehicle.

18. The method of claim 1, wherein said automatic action for avoiding a collision comprises sending a warning signal to said cell phone of said traffic participant.

19. The method of claim 1, wherein said processing unit processes the signal of the cell phone with a frequency or intensity that depends on a position of said vehicle.

20. The method of claim 1, wherein said signal from said cell phone is sent in reaction upon a triggering signal of the vehicle in the neighborhood of said traffic participant.

21. The method of claim 1, wherein said signal of the cell phone is only sent in case that said cell phone is moving.

22. A method for avoiding a collision between a vehicle and a pedestrian comprising the following steps:

a) a cell phone carried by the pedestrian sends a signal including positions of the pedestrian, b) a processing unit processes the signal including the positions of the pedestrian for a position history or evaluation history, c) the processing unit determines an estimation of a future position of the pedestrian on the basis of the position history or evaluation history, d) a vertical acceleration of the pedestrian is sensed by an acceleration sensor of a cell phone carried by the pedestrian, wherein said acceleration sensor is also used for a manipulation of the operating state of said cell phone by moving said cell phone and e) an action for avoiding a collision is automatically initiated in case that a distance of the future position of the pedestrian and said vehicle is smaller than a safety distance, wherein ea) the safety distance depends on the vertical acceleration sensed by the acceleration sensor of the cell phone and eb) an increased frequency of the measured vertical acceleration is used as an indicator that the pedestrian is stressed or in a hurry and considered by increasing the safety distance.

* * * * *